United States Patent [19]

Gstöhl

[11] Patent Number: 4,803,934

[45] Date of Patent: Feb. 14, 1989

[54] DEVICE FOR PRODUCING A HEAT AND TENSION RESISTANT AS WELL AS FLEXIBLE CONNECTION BETWEEN THE ENDS OF WEB-LIKE MATERIALS

[76] Inventor: Josef Gstöhl, Ackerstrasse 35, CH-8604 Hegnau, Switzerland

[21] Appl. No.: 117,069

[22] PCT Filed: Jan. 27, 1987

[86] PCT No.: PCT/EP87/00035

§ 371 Date: Oct. 2, 1987

§ 102(e) Date: Oct. 2, 1987

[87] PCT Pub. No.: WO87/04735

PCT Pub. Date: Aug. 13, 1987

[30] Foreign Application Priority Data

Feb. 3, 1986 [AT] Austria ..... 241/86
Oct. 27, 1986 [AT] Austria ..... 2853/86

[51] Int. Cl.[4] ..... D05B 3/00
[52] U.S. Cl. ..... 112/121.14; 112/307
[58] Field of Search ..... 112/121.14, 121.11, 112/121.12, 307, 121.15

[56] References Cited

U.S. PATENT DOCUMENTS 3,160,124 12/1964 Cash ..... 112/121.14
3,395,658 8/1968 Lee et al. ..... 112/121.14
3,515,080 6/1970 Ramsey ..... 112/121.12 X
3,765,349 10/1973 Gerber ..... 112/121.11 X
4,131,074 12/1978 Riss ..... 112/121.14
4,557,206 12/1985 Iwase ..... 112/121.14

FOREIGN PATENT DOCUMENTS 0063546 7/1984 European Pat. Off. .

*Primary Examiner*—H. Hampton Hunter
*Attorney, Agent, or Firm*—Toren, McGeady & Associates

[57] ABSTRACT

A device for producing a heat and tension resistant, flexible connection between a thread layer of parallel threads and a web-shaped material. The device includes a sewing arrangement for sewing the thread layer and the web-shaped material together at the point of connection. In particular, the device includes clamping arrangements for sandwiching the thread layer between a continuous length of the web-shaped material and a relatively short length of the material. The sewing arrangement is then caused to traverse across the width of the thread layer and web-shaped material between the clamping arrangements thereby sewing a seam therethrough connecting the web-shaped materials to the thread layer.

23 Claims, 6 Drawing Sheets

DEVICE FOR PRODUCING A HEAT AND TENSION RESISTANT AS WELL AS FLEXIBLE CONNECTION BETWEEN THE ENDS OF WEB-LIKE MATERIALS

BACKGROUND OF THE INVENTION

1. Field of the Invention:

The invention is directed to a device for production of a heat and tension resistant as well as flexible connection between the ends of web-like materials, particularly between a layer from a plurality of parallel threads (thread layer) and a web-like material with a first retaining device for temporarily securing the free end of a web-like material coiled on a storage drum and unwindable from said drum wherein the retaining device is arranged on the side of the transport plane of the thread layer and that a clamping device for the thread layer is located downstream of this retaining device viewed in the transport direction of the thread layer, the transport plane extending between the jaws of the clamping device displaceable against each other.

2. Description of Related Art

In textile technology, the task often arises to unite area formations with each other, particularly if textile webs, which are processed continuously, are to be connected with other textile webs independently of the fact whether these other textile webs are only auxiliary devices with which the processing method is being performed or whether they are textile webs which are subjected to the process itself. In such a processing method, the textile webs to be worked are not completely pulled out of the processing machine, rather a new web is connected to the web which is running out. It is thus avoided that the processing machine, which has an extraordinary length for such textile processing methods, idles, which entails costly additional work processes, a new web must be inserted, the machine at standstill must be cleaned and more of the same. In the ensuing description and also in the claims terms such as thread layer, web- or layer-like material signify a fibrous two-dimensional material, whose thickness has only a very low magnitude in comparison with the width and especially the length. Thus we are dealing, as a rule, always with textile webs in the most general sense of this term and by this are meant woven and not woven fabrics, fleeces or mats, hoisery goods, and also single layer or multilayer webs, also when they are constituted by parallel assemblage of threads, for instance filling- or warp threads.

Textile processing methods which are performed in installations having a large extension as far as lengths are concerned, are washing, singeing, bleaching, dressing, printing, finishing and more of the same. Assemblages of yarns are mostly dyed and sized.

Processes and measures for treatment of yarn assemblages instead of the finally obtained tissue are becoming more and more widespread and, in the case of this process, all the upgrading operations can be performed to the extent that this appears desirable with a view to the subsequent processing steps. Such processes are for instance described in the Swiss patent publication No. 612 557 and in the French patent publication No. 12 01 724.

It is very cumbersome and difficult to draw in or to reinsert threads which are subjected to such processing methods into a processing machine or installation, in order to replace the already introduced and processed threads, since the quantity of the parallel threads which pass through such an installation is extraordinarily great. Their number lies approximately between 7 to 10,000 and the drawing in lengths themselves reach notable values. Lengths amounting to 350 and more meters must here be reckoned with.

When tissues are subjected to such processing methods and processing steps, the previously described difficulty exists only to a slight extent, since in this case the initial regions of the new tissue are simply connected to the end regions of the just treated tissue by one or several seams, which are produced with manual sewing machines.

A measure is explained in the European patent publication No. 00 63 546 which permits connecting such thread layers with a textile web. In the case of such thread layers, one is dealing with textile formations which unravel in longitudinal direction, meaning in the direction of pull similar to mats and parallel assemblages of yarns. The connection proposed in the European patent application No. 00 63 546 consists now of a bonding or hot sealing which is shielded by a heat insulating layer at least on the side which is exposed to temperature effects during normal plant operations. For this purpose the layer consisting of a plurality of parallel threads in stretched state is secured according to the known proposal and in effect between a first strip from a weldable or heat sealable plastics material, which is fastened to a tissue and a second weldable or heat sealable strip, wherein the planes of both strips and the thread layer extend essentially parallel to each other. Then the strips and the thread layer are pressed together and the two strips are connected with each other by hot welding or hot sealing, wherein the thread layer is, so to speak, wedged between the strips by this hot sealing or welding process.

This measure has been fully proved and is also successfully used in actual practice. The only disadvantage of this measure lies therein, that the weldable or heat-sealable materials are extraordinarily expensive compared to normal simple tissues and that such weldable or heat sealable fabrics must be used in large quantities when using this method which makes this known measure expensive.

SUMMARY OF THE INVENTION

An object of the subject invention is to design a device of the previously mentioned type in such a way that one can do without the utilization of such very expensive weldable and heat sealable materials which in addition are required in large quantities. This is achieved in the subject invention by providing guides on both sides of the transport plane of the thread layer as well as transversely to the transport direction of the thread layer, wherein a needle head having at least one sewing needle for an upper thread is provided at one guide and where a shuttle head having a shuttle or gripper mechanism for a lower thread is arranged at the guide located on the other side of the transport plane of the thread layer, and that both heads are synchronously drivable and synchronously displaceable along the uides and that the first retention device, viewed in transport direction of the thread layers lies behind an imagined plane which contains both heads with the needles and the shuttle for temporarily securing the free end of the web-shaped material.

Another proposal for a solution of simpler mechanical construction consists in that guides are provided at least on one side of the transport plane of the thread layer and also transversely to the transport direction of same, wherein at least one sewing arrangement is displaceably supported at the guides with at least a needle head having a sewing needle for an upper thread and a shuttle head having a shuttle or gripper mechanism for a lower thread, and that a pair of rollers is provided between the transfer plane of the thread layer and the sewing arrangement, wherein the axes of the rollers extend parallel to the guides, and the one roller lies above and another roller below the imagined plane standing at right angles to the operating direction of the sewing needle, both rollers being spaced from each other and that a slide is provided near or in the imagined plane, which lies on the side of the transport plane facing away from the sewing direction, the slide being movable against the transport plane and beyond this transport plane and that the end of the material secured by the retention device is led past this slide.

It must be observed at this time that it is known to connect tissue webs with each other by means of seams, as has already been pointed out in the introduction. In such a case the initial region of the new tissue is simply sewn to the end region of the just treated tissue. This is done with manual sewing machines. If, however, textile formations are present which unravel in the longitudinal direction, such as mats or parallel thread assemblages, such a solution (connection by sewing) was viewed to be unusable. It is, however, now possible, contrary to this view, to connect thread layers with a web- or layer-like material exclusively by seams so as to be heat- and tension-resistant as well as flexible, so that the expensive and cumbersome heat sealing and weldable materials can be obviated. By the term needle head in the sense of this description, it is meant a mechanical arrangement with at least one reciprocating sewing needle which guides an upper thread, as is known in sewing machines. By the term shuttle head, it is meant a mechanical installation in the sense of this invention, which includes shuttles or grippers which guide a lower thread and which cooperate with the needle of the needle head, in order to produce a seam consisting of at least two threads.

BRIEF DESCRIPTION OF THE DRAWINGS

In order to illustrate the invention, the same is now described with particularity with the help of two embodiment examples shown in the drawings, in which.

DESCRIPTION OF THE PREFERRED EMBODIMENTS

Figure 1:
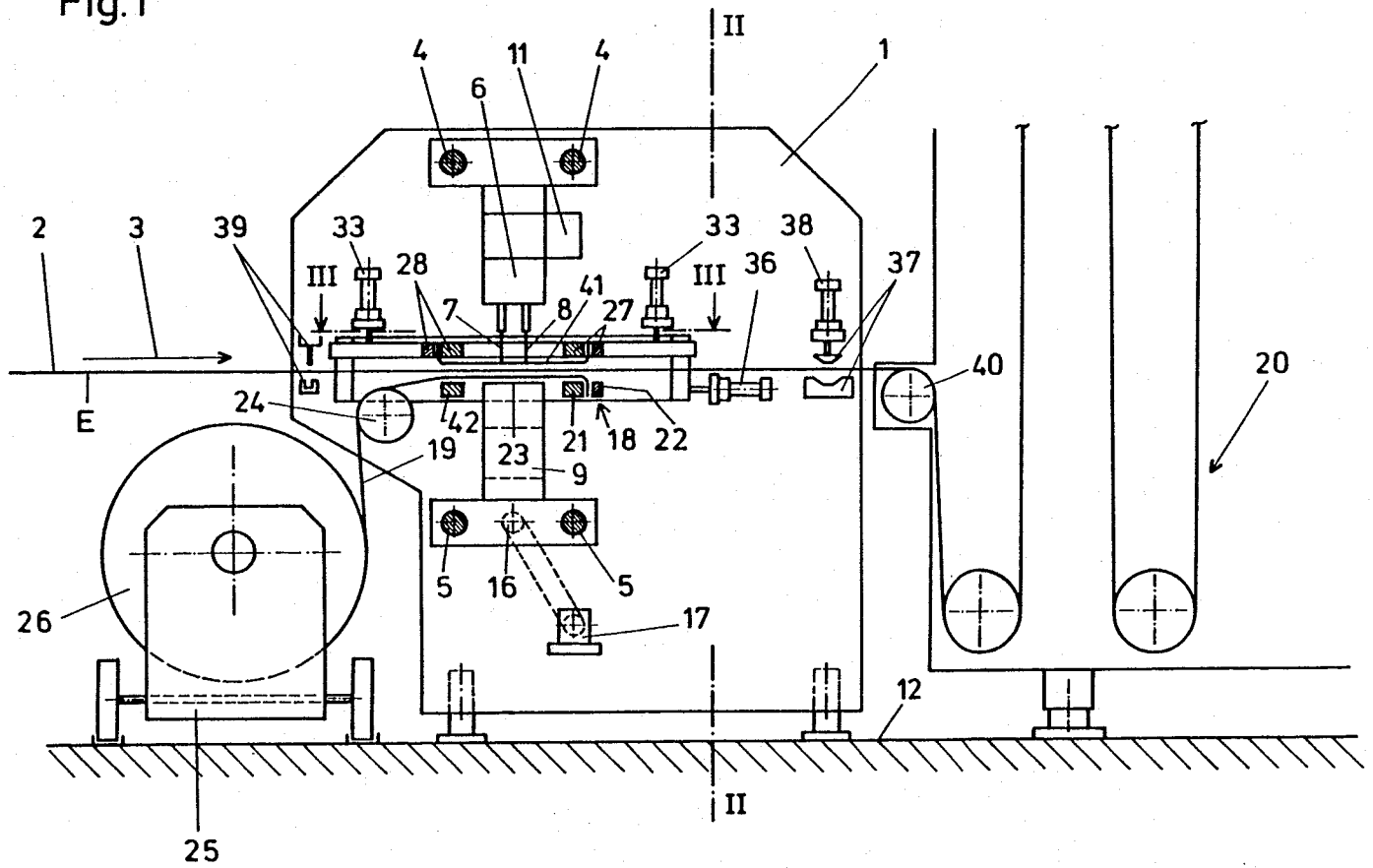
FIG. 1 is a longitudinal section through a first embodiment, which is arranged at the entry region of a thread processing machine.
Figure 2:
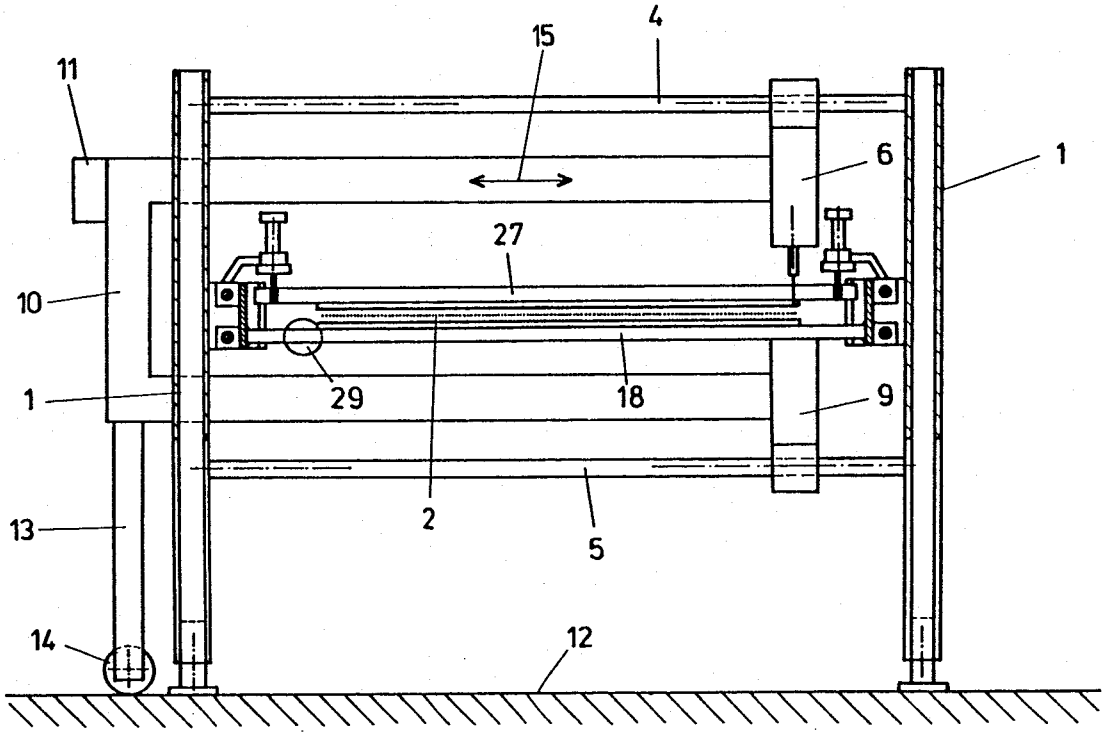
FIG. 2 is a cross-sectional view through the embodiment of FIG. 1, taken along section line II—II in FIG. 1.

The device in FIG. 1 represents a first embodiment of the invention and is arranged at the inlet side of a thread treatment installation, of which, however, here only the so-called compensator 20 is depicted. In a suitable machine stand 1, which is not shown in detail here, a horizontally extending transport plane E is depicted by a thread layer 2 passing transversely through the device in the sense of the above statements; the transport plane is located approximately at half the height of the device. The transport direction in which the thread layer 2 travels through the installation and the device, is designated by an arrow 3. Rail-like guides 4 and 5 are provided above and below this transport plane to be stationary in the machine stand 1. A needle head 6 is displaceably supported along the upper guide 4 and is connected with same. The needle head 6 carries two needles 7 and 8. These two needles 7 and 8 are offset in transport direction (arrow 3) as is shown in FIG. 1. During routine operation, this needle head 6 moves perpendicularly to the drawing plane in FIG. 1. A machine head 9, herein called shuttle head 9 in the following discussion, is displaceably supported along the guide 5 and is connected with same, in which shuttle head shuttle or gripping mechanisms are arranged. The needles 7 and 8 guide an upper thread, while the shuttles or grippers guide a thread. By needle head in the sense of the present invention, a mechanism is understood as it is known from sewing machines. The needles 7 and 8 are moved in the direction of their axes and include an eyelet next to their pointed end through which the upper thread is threaded. By shuttle head in the sense of this invention, a mechanical appliance is understood in which shuttles or grippers are supported which guide the lower thread and which coact with the reciprocating needle for producing a stitch in the usual manner. In the present embodiment, the two machine heads 6 and 9 are connected with each other by a U-shaped yoke 10 (FIG. 2), whose depth is larger than the width of the thread layer 2 which is to be treated. The plane of the yoke 10 stands herein at right angles to the drawing plane in FIG. 1 or it lies parallel to the drawing plane in FIG. 2. A drive motor 11 for the sewing needles 7 and 8 and the shuttle head is appropriately flanged directly at this yoke 10 and the driving elements for the synchronous drive of needle and shuttle run expediently in the legs of this yoke 10 constructed as hollow boxes. The section connecting the two legs of the yoke 10 is, as FIG. 2 shows, abutted against the floor 12 through a post 13 with a traveling roller 14, which is expediently guided along a guide track. The operational direction of the yoke 10 is indicated by an arrow 15 in FIG. 2. The shuttle head 9 is furthermore penetrated by a stationarily supported however rotatable threaded spindle 16 which is drivable by a stationary motor 17. The yoke 10 and with it the needle head 16 and the shuttle head 9 are displaced synchronously at right angles to the drawing plane in FIG. 1 by the rotating spindle 16.

Beneath the transport plane E and behind the plane of motion of the two heads 6 and 9, viewed in the transport direction (arrow 3), there is arranged a first retaining device 18 which is constituted by two strip-shaped clamping jaws 21 and 22 displaceable against each other; for reasons of clarity the displacement means for these two jaws 21 and 22 is not shown here in FIG. 1. Expediently, hydraulically or pneumatically actuated piston cylinder units can be used as displacement means. This retention device 18 is arranged in such a manner with respect to the shuttle head 9, that its support plane for the web- or layer-like material 19 lies approximately at the same level as the support plane 23 of the shuttle head 9, in front of which, also viewed in transfer direction (arrow 3), and beneath the transport plane E, a freely rotatable reversing roller 24 is supported in the machine stand 1.

A trolley 25 is supported displaceably at right angles to the drawing plane in FIG. 1 upstream of the machine stand 2 of the device and also beneath the transport path E, which trolley carries a storage roller 26 on which the web- or layer-like material is coiled.

Above the transport plane E and thus above the thread layer 2 there is now provided a second retention device consisting of two clamping strip pairs 27 and 28. The two clamping strip pairs 27 and 28 are arranged in such a manner that an imagined displacement plane of the needle head 6 lies between them, in other words the two clamping strip pairs 27 and 28 lie respectively on different sides of the needle head 6 and extend also at right angles to the drawing plane in FIG. 1. Displacement means 29 and 30 are provided also for these clamping strip pairs 27 and 28, which, however, are not depicted in FIG. 1 for reasons of clarity.

Respectively, one strip of the two clamping strip pairs 27 and 28 is connected at its end with a cross tie 31 and these parts together form a frame 44 which can be elevated and lowered along vertical guides 32 by means of a displacement device 33. These vertical guides 32 are part of a sled 34, which, on its part, is horizontally displaceable along a guide 35 stationary with respect to the machine stand 1. A piston cylinder unit serves also in this case as displacement device 36.

A clamping arrangement 37, through whose two clamping jaws passes the transport plane E or the thread layer 2, is provided on the side of the machine stand facing the thread treatment installation. Here also a piston cylinder unit 38 serves for actuation of the clamping arrangement 37. In addition, a knife edge 39 is provided opposite the clamping arrangement 33 on the inlet side of the device or the machine stand 1; the actuation device of this knife edge 39 is, however, not shown here. So much concerning the design structure of the appliance.

The operating mode of this appliance will now be described: A parallel assemblage of thread or yarn, designated here as thread layer 2, runs off warp beams not depicted here and enters into the appliance from the left-hand side (FIG. 1), passes through the appliance and subsequently over a first reversing roller 40 into the thread treatment installation proper with the compensator 20 arranged upstream, where it is subjected to the actual consecutive treatment processes. The thread layer 2 travels along the path indicated through the previously explained parts, whose cooperation is explained in the following. Herein, it is assumed that FIG. 1 shows these parts in their respective position which they assume during the normal operating cycle, meaning the knife edge 39 and the clamping arrangement 37 are opened, the clamping pairs 27 and 28 are lifted up, as well as the needles 7 and 8 of the needle head 6 and the drive motor 17 is not running. A length of cloth is coiled on the storage roller 26 and a piece of this cloth 19 is pulled off, guided over the reversing roller 24 and the shuttle head 9 and its free end is clamped in the first retention device 18. This piece of cloth 19 is stretched, since it has been pulled off the storage roller 26 against the action of a pull-off brake arranged thereon however not depicted here. Furthermore, a strip of cloth 41 is held and stretched by the two clamping strip pairs 27 and 28, which strip of cloth, as seen in FIG. 1, lies above the thread layer 2 or the transport plane E. This arrangement applies to and shows the appliance if the thread layer 2 passes through the treatment installation in an orderly manner, and if an adequate yarn supply stock is still available on the not depicted warp beams.

If now the thread layer 2 approaches its end, the required connection with the material 19 must be produced and to begin with, now, the further travel of the thread layer 2 through the appliance in the invention is stopped, by actuating the clamping arrangement 37 which closes and now holds the thread layer 2 by clamping it between its two jaws. The thread layer 2 in FIG. 1 on the left-hand side of the clamping arrangement 37 remains however taut, because of the windoff resistance from the warp beams and possibly because of its own windoff brakes not provided here. The treatment process in the treatment installation continues however to operate in a unimpeded manner, because a sufficient amount of thread layer to be treated is stored for this purpose in the compensator 20.

Figure 3:
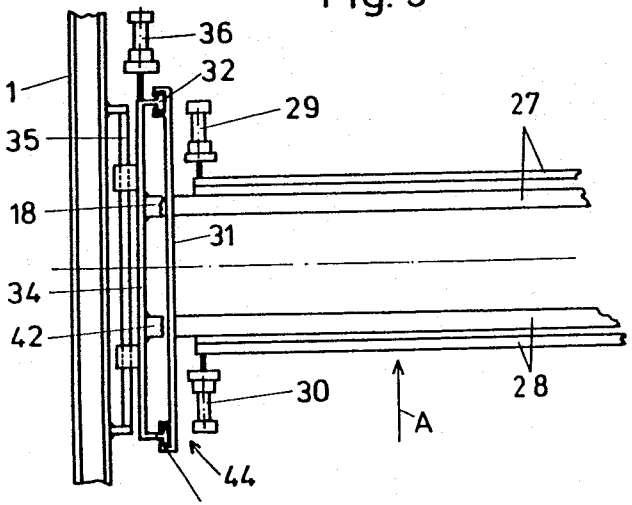
FIG. 3 is a detail plan view of the embodiment of FIG. 1 in the direction of the section line III—III in FIG. 1.
Figure 4:
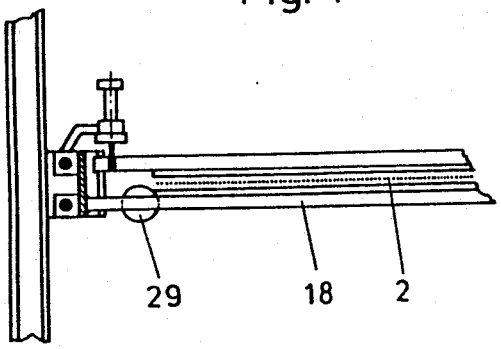
FIG. 4 is a front view of the embodiment of FIG. 3 (viewing direction arrow A in FIG. 3)

Now the piston cylinder units 33 are made to operate and thereby the clamping strip pairs 27, 28 and the cloth strip 41 maintained by them in a taut state are lowered to such an extent that the cloth web 19, the thread layer 2 and the cloth strip 41 rest on the support surface 23 of the shuttle head 9. Here the thread layer 2 is clamped between the closed clamping strips or pressure strips. Now the drive motor 11 for the sewing arrangement and the drive motor 17 for the displacement of same are switched on and the three mentioned parts 2, 19 and 41 are now sewn together, and indeed by a travel sequence of the sewing arrangement through two seams, which are offset with respect to each other because of the selected arrangement of the needles 7 and 8. If the sewing arrangement, consisting of the heads 6 and 9 and starting from the initial position shown in FIG. 2 has now reached its left end position (FIG. 3), then the drive motor 11 for the sewing arrangement is stopped for a short time with lifted-up needles 7 and 8 and the closed and pressing against each other clamping strip pairs and pressure strips 18, 27, 28, 42 are pulled somewhat to the right and then the drive motors 11 and 17 are restarted, wherein the yoke 10 returns into its initial position discernible in FIG. 3, whereby simultaneously again two seams are produced.

As soon as the yoke 10 has reached its initial position (FIG. 3), the motors 11 and 17 are stopped. The needles 7 and 8 are lifted up, the clamping devices 18, 27 and 28 are opened and the jaws are spread apart and the thread layer 1 itself is severed by actuating the knife edge 39 and then the clamping arrangement 37 is opened. The pulling force acting from the thread treatment installation now pulls the cloth 19 from the storage roller 26 by means of the thread layer 2 still traveling in this treatment installation. This cloth 19 is intended in the thread treatment process which is not described in detail here to serve only as a production assist means and it is repeatedly reusable and reutilizable. For this purpose a normal simple cloth consisting of filling- and warp threads can be used, other materials however are also possible, for instance laminated materials, such as plastics material foils or the like.

Figure 5:
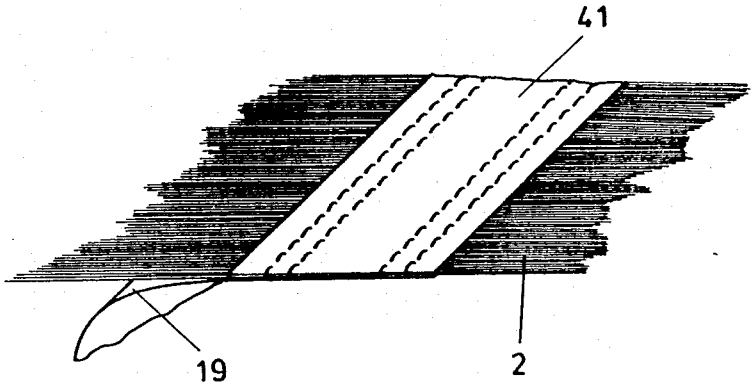
FIG. 5 shows the connection produced with the embodiment of FIGS. 1 to 4 in an oblique view.

FIG. 5 shows an oblique view of a connection between the material 19, the cloth strip 41 and thread layer 2. The four seams shown here are offset with respect to each other. As tensile tests with connections produced in this manner have shown, these can carry an extraordinarily high load. This connection, as described above and illustrated in FIG. 5, consists of the mentioned four seams offset against each other and the two cloths 19 and 41, in between which the thread layer 2 is held. It is also possible to repeatedly operate the sewing arrangement with the head 6 and 9 during the fabrication of a connection, so that not only four, but rather, for instance, eight seams are produced. It is also possible to arrange more than two needles in the needle head, so that when operating the sewing arrangement more than two seams are produced simultaneously.

Figure 6:
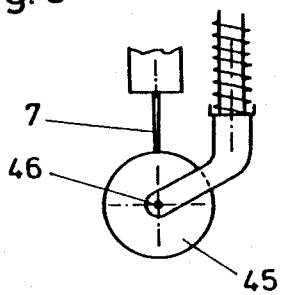
FIG. 6 shows a hold down device for the needles of the needle head in front view.

The upper cloth strip 41 assumes two tasks in this connection; on the one hand, it serves as the connecting element proper and, in addition, it serves for permitting the hold-down device which is assigned to each needle to slide unimpaired across the material to be sewn. If no particularly great requirements are specified for the tensile strength of the connection, it is quite imaginable to, for instance so-to-speak, leave off the upper strip 41 when producing said connection. So that one can sew without difficulty in such a case it is provided that the hold-down device (see FIG. 6) coacting with the sewing needle of the needle head 6 is designed as a disk 45 supported in a freely rotatable manner, whose axis of rotation 46 lies parallel to the transfer arrangement (arrow 3) of the thread layer 2.

In the embodiment example shown, the needle head 6 and the shuttle head 9 are mechanically connected with each other by a yoke 10. During the sewing process this yoke 10 migrates to the side. An appropriate space must be provided for this purpose in the room housing the machines. It is also possible to use the needle head 6 and the shuttle head 2 as independent units mechanically separate from each other, and also to do without the yoke 10 connecting same. Based on the modern electronic control regulation installations available today, an exact synchronous operation of these components spacewise separate from each other can be achieved without the use of such a mechanical connection by a yoke 10.

Figure 7:
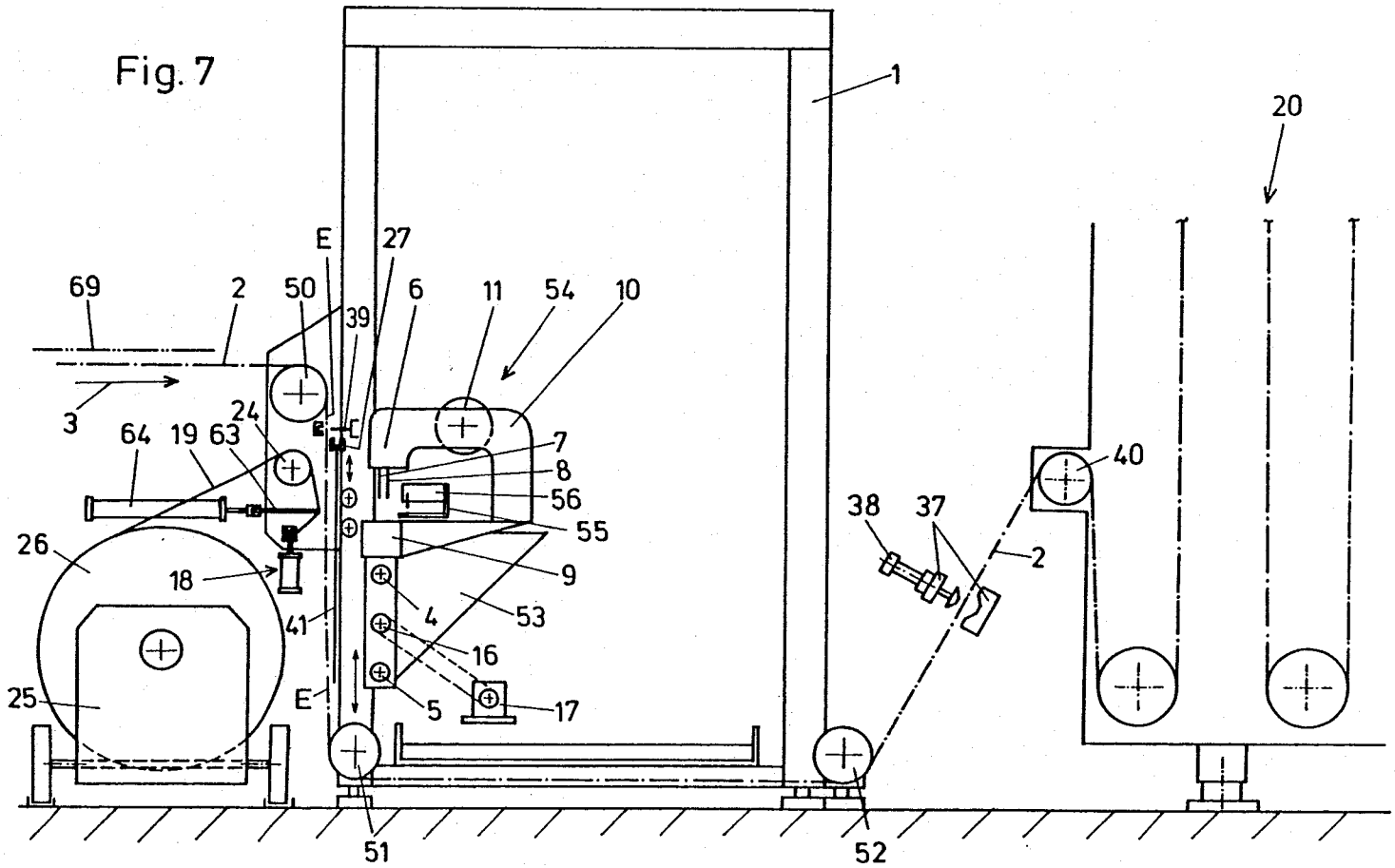
FIG. 7 shows a side view of a second embodiment which is arranged at the inlet region of a thread processing machine.

The FIGS. 7 to 10 illustrate a second embodiment of the invention, which has a simplified construction compared to the first embodiment which has initially been described here. The same designation numerals are used in order to designate identical parts in the two embodiments. The device in FIG. 7 is also arranged in a stationary manner at the inlet side of a thread treatment installation, of which however, also here only the so-called compensator 20 is shown. In a suitable machine stand 1, not shown here in detail, the transport plane E, extending in an angular manner through a thread layer 2 passing through the device, is illustrated in the sense of the above discussion. The transport direction in which the thread layer 2 passes through the installation and the device is designated by an arrow 3.

The thread layer 2 runs at a level of approximately half the height of the machine stand 1 in the direction of the same stand and is vertically redirected downwards by a freely rotatable reversing roller 50. Additional reversing rollers 51 and 52 are provide in the machine stand 1, by means of which the thread layer 2 is directed to the compensator 20. It has already been observed at this point, that the reversing rollers 51 and 52 are not supported to be stationary in the base area of the machine 1, but rather the reversing rollers 51 and 52 displaceable vertically. The arrow in FIG. 1 above the reversing roller 51 indicates this vertical displacement possibility.

In the area between the reversing rollers 50, 51 and in the area of the inlet side of the machine stand 1, the thread layer 2 or the transport plane E runs vertically. In this vertically extended segment of the transport plane E and sidewise of the same rail-like guides 4 and 5 located one above the other are provided to be stationary in the machine stand 1. A support 53 is displaceably arranged at these rail-like guides 4 and 5 and indeed at right angles to the drawing plane, where a stationary, however, rotatably supported threaded spindle 16 lying parallel to these rail-like guides 4 and 5 serves for displacing said support 53; said threaded spindle 16 is drivable in both directions of rotation by a motor 17 which has been illustrated here in simplified manner, so that said support 53 can be displaced into the drawing plane as well as out of the drawing plane.

This support 53 carries a sewing arrangement 54 with a sewing head 6 and a shuttle head 9, which are both connected with each other by a relatively short yoke 10, wherein a driving mechanism for needle and shuttle or the gripper is housed in this yoke 10 as is usual in sewing arrangements of this type. A motor 11 flanged to the yoke 10 serves for driving this mechanism. The needle head 6 carries two needles 7 and 8 in this embodiment example shown, which are differently spaced as against the transport plane E and which are additionally offset against each other when viewed at right angles to the drawing plane.

The needles 7 and 8 guide the upper thread while, the shuttle or gripper guides the lower thread. By needle head in the sense of the present invention, a mechanism is understood such as it is known from sewing machines. The needles are movable in the direction of their axes and carry an eyelet near their pointed end, through which the so-called upper thread is threaded. By shuttle head in the sense of this invention, a mechanical arrangement is meant in which shuttles or grippers are supported, which guide the lower thread and conventionally coact with the reciprocating needle for producing a stitch. For the purpose envisaged here, a commercially available sewing machine with a set of double needles can be used on this support 53.

Figure 8:
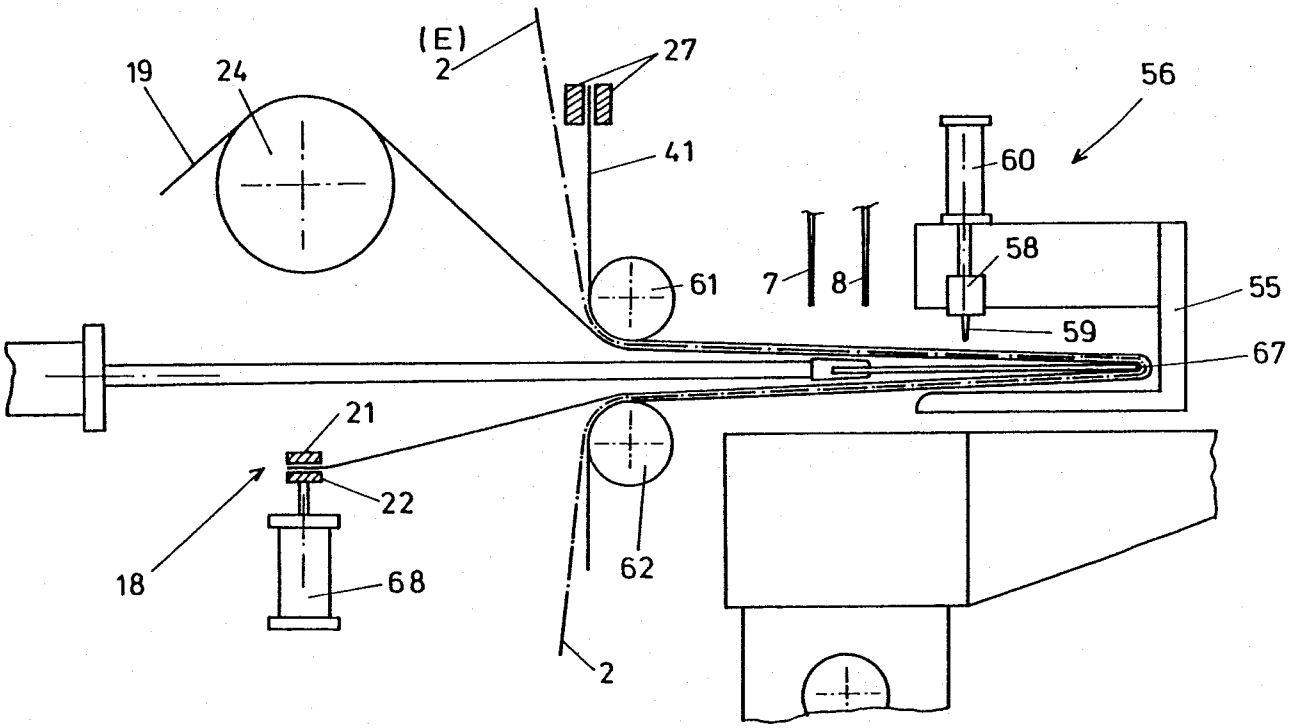
FIG. 8 is a detail from FIG. 7 in enlarged scale.

A support beam 55 with a clamping arrangement 56 extends on the side of the needles 7 and 8 of the needle head 6 across the entire width of the machine stand 1 on the side facing away from the transport plane E. This clamping arrangement comprises a clamping strip 58 elevatable and lowerable by one or several power cylinders 60, said claiming strip 58 being equipped across its length with several needle-like pins 59, which are spaced from each other (FIG. 8 at right angles to the drawing plane).

A pair of rollers consisting of two superimposed rollers 61 and 62 is provided between the transport plane E of the thread layer 2 and the sewing arrangement 54, wherein the axes of these rollers extend parallel to the guides 4 and 5. The one roller 61 is herein located above and the other roller 62 below an imagined sewing plane extending at right angles to the working direction of the sewing needles 7 and 8, which, in the second embodiment in FIG. 7, is to be imagined as a plane extending horizontally and standing at right angles to the drawing plane. The two rollers 61 and 62 which are superimposed are spaced from each other. They are, however, adjustable in the plane containing their axes for the purpose of reducing their mutual spacing. The mechanism serving for this purpose has not been shown here for reasons of clarity. The adjustment of a roller can, for instance, be achieved in that the shafts or axis of the roller is supported at its outer ends in bearing blocks to be freely rotatable, and that these bearing blocks are supported to be vertically displaceable along the machine stand, wherein a power cylinder can be used for this displacement, whose one end is fastened to the machine stand and whose other other end is fastened at the bearing block.

Figure 9:
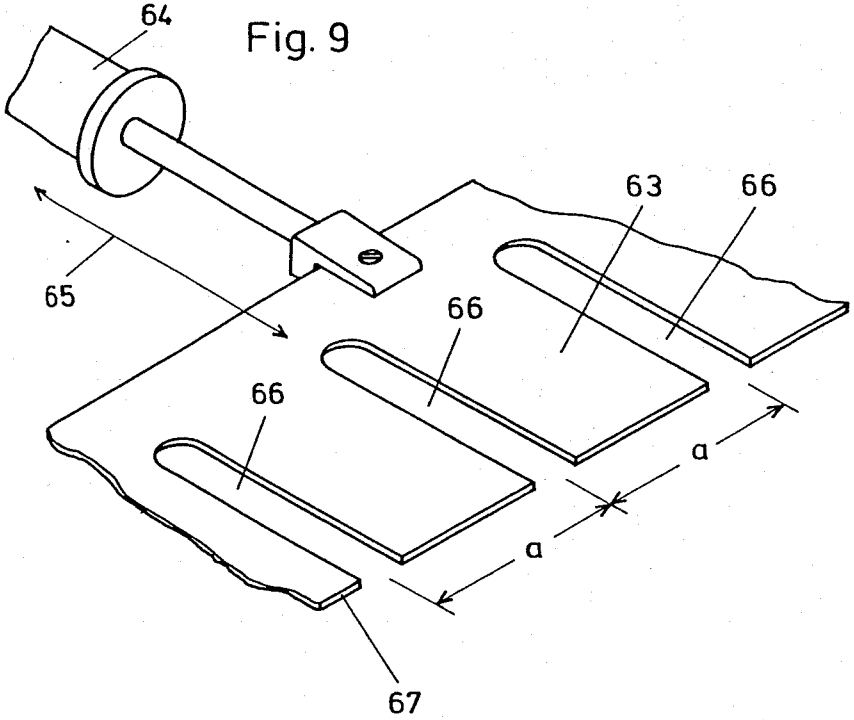
FIG. 9, a partial front view of the slide in oblique view.

A slide 63 lies closely to or in the mentioned sewing plane on the side of the transport plane E facing away from the sewing arrangement 54; the slide 63 is displaceable in this plane or parallel thereto by means of a piston cylinder unit 64. This slide 63 which also extends across the entire width of the appliance, comprises slots 66 extending parallel to its displacement direction 65, emanating from its front edge 67 which is the edge of the slide 63 adjacent to the transport plane E and parallel to it. This slide 63 is, as FIG. 9 illustrates, an elongated strip-like constructional component. The mutual distances a of these slots 66 correspond to the spacing of the needle-like pins 59 at the clamping strip 58.

The retention device 18 is arranged beneath the slide 63 in the embodiment example shown in FIG. 7; said retention arrangement has a fixed strip-shaped clamping jaw 21 and a movable, also strip-shaped, clamping jaw 22, which can be pressed by the piston cylinder unit 68 against the stationary clamping jaw 21.

It is basically conceivable and should be mentioned at this time, that this retention device 18 can be arranged directly at the slide 63, wherein for instance the slide 63 constitutes the fixed clamping strip. Above the slide 63 an additional reversing roller 24 is supported to be freely rotatable at or in the machine stand 1.

A trolley 25 is supported to be displaceable at right angles to the drawing plane in FIG. 7 upstream of the machine stand 1 of the appliance and also beneath the transport path E; said trolley carries a storage roller 26 on which the web-or layer-like material 19 is coiled.

An additional clamping strip pair 27 is provided in the region of the rollers 61, 62 of the roller pair, at which clamping pair a cloth strip 41 is clamped at its upper edge. This cloth strip 41 hangs freely downwards and lies between the transport plane E and the rollers 61 and 62 of the roller pair and extends appropriately beyond these rollers 61 and 62 downwards as is illustrated here in FIG. 7.

An additional clamping arrangement 37 is provided between the two reversing rollers 52 and 40 on the side of the machine stand 1 which faces the thread treatment installation, through the two clamping jaws of whose clamping arrangement extends the transport plane E or the thread layer 2. A piston cylinder unit 38 serves here also for actuating this clamping arrangement. On the inlet side of the appliance or the machine stand 1 a knife edge 39 is additionally provided whose actuation unit is however not shown here. So much for the design of the device.

The functional mode of this device is described in the following: a parallel thread assemblage of threads or yarn, designated here as thread layer 2 runs off warp beams (not shown) and enters the appliance from the left (FIG. 7), then over freely rotatable reversing drums 50, 51, 52 and through these, subsequently over the additional reversing roller 40 into the thread treatment installation proper with the compensator 20 located upstream, where it is sequentially subjected to the treatment processes proper. The thread layer 2 passes the previously explained parts along the demonstrated path, whose coaction will be explained in the following. Herein it is assumed that FIG. 7 shows these parts in their respective position which they assume during the normal working cycle, meaning the knife edge 39 and the clamping arrangement 37 are open, the clamping strip 58 is lifted up, as well as the needles 7 and 8 of the needle head and the drive motor 17 is not running. A cloth web is coiled on the storage roller 26 and a piece of this cloth web 19 is pulled off, led over a reversing roller 24 and past the slide 63 and the free end is clamped in the retention arrangement 18. This cloth web 19 is slightly stretched, since is has been pulled off the storage roller 26 against the action of a pull-off brake arranged there but not illustrated here. Furthermore, a cloth strip 41 is held by the clamping strip pair 27, which cloth strip 41 hangs freely downwards as has already been described. This arrangement is directed to and describes the appliance if the thread layer 2 passes the treatment appliance in an orderly manner, and if a sufficient thread supply remains on the warp beams.

If however now the thread layer 2 approaches its end, the required connection with the material 19 must be produced and to begin with the further travel of the thread layer 2 is halted by the device of the invention, by actuating the clamping arrangement 37, which closes and now retains the thread layer 2, by clamping same in between the two jaws. The thread layer 2 on the left of the clamping arrangement 37 in FIG. 7 remains taut, however due to the windoff resistance from the warp beams or possibly because of its own windoff brakes (not shown). The treatment process however continues unhindered in the treatment appliance, because the compensator 20 contains a sufficient amount of the thread layer to be treated for this purpose.

Now the piston cylinder unit 64 is put into operation which causes the slide 63 to move to the right and, in the course of this, pulls not only a portion of the material web 19 with it, but rather also the thread layer 2 and the cloth strip 41 (FIG. 8) hanging freely downwards, and the slide 63 pushes these layers through the two spaced rollers 61, 62 until its front edge 67 has arrived beneath the clamping strip 58 of the clamping arrangement 56. In the course of this simultaneously the lower reversing roller 51 and eventually also the reversing roller 52 move somewhat upward, so that this releases sufficient "material supply", in order to enable the sidewise displacement of the material webs discernible in FIG. 8. Subsequently the clamping strip 58 is lowered and the needle-like pins 59 pierce the multilayer material web (Fig. 8), whereby the descending pins are received by the slots 66 of the slide 63. Now the slide 63 returns again into its original position and the material- and thread webs are retained by the pins 59 and subsequently the rollers 61 and 62 travel towards each other and meet, so that the material webs and thread layer lie closely one upon the other between these rollers 61 and 62 and the pins 59 of the clamping arrangement 56.

At this point the drive motors 11 for the sewing arrangement and the drive motor 17 for the displacement of same are switched on and the three mentioned parts 2, 19 and 42 are now sewn together, by two seams in the course of a movement sequence of the sewing arrangement, which seams are offset with respect to each other because of the selected arrangement of the needles 7 and 8. When the sewing arrangement 54, consisting of the heads 6 and 9 and emanating from its initial position has reached its end position on the other side, the drive motor 11 for the sewing arrangement is stopped with needles lifted up, the rollers 61 and 62 return again into their original position and the clamping strip 58 is raised. Subsequently the thread layer 2 itself is severed by actuating the knife edge 39 and the clamping arrangement 37 is again opened. The pulling force acting from the thread treatment installation now pulls the cloth 19 from the storage roller 26 by means of the thread layer 2 which is still traveling in this treatment installation. This cloth 19 is intended in the thread treatment process, which is not described here in detail to serve as an auxiliary production assist means and it can be repeatedly reused and reutilized. Normal simple cloth may be used for this purpose, which consists of filling and warp threads; other materials are, however, also imaginable, for instance laminated materials such as plastics material foils or the like.

Figure 10:
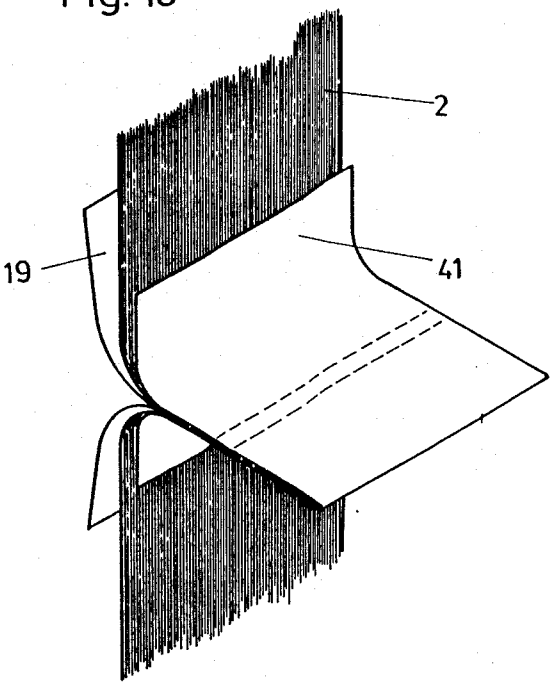
FIG. 10 shows the connection produced with the second embodiment in oblique view.

A connection between the material 19, the cloth strip 41 and the thread layer 2 is shown in oblique view in FIG. 10. In this case, the two seams are offset with respect to each other. The tensile tests with connections thus produced have shown that they can carry high loads. These connections, as described above and illustrated in FIG. 10, consist of the mentioned offset seams and the two pieces of cloth 19 and 41 in between which the thread layer 2 is retained. It is also possible to arrange more than two needles in the needle head, so that during operation of the sewing device more than two seams can be produced simultaneously.

The upper cloth strip 41 assumes two tasks in this connection, on the one hand it serves as the connection element proper, and furthermore it enables the hold down device assigned to each needle to slide without hindrance across the material being sewed. If no particular requirements are demanded as far as tensile strength is concerned, it is quite imaginable to leave off the upper strip 41 when producing these conditions. So that one can sew in this case without difficulty, it is provided that the hold down device (see FIG. 6) coacting with the sewing needles of the needle head is designed as a disk 45 supported so as to be freely rotatable, whose rotational axis 46 lies at right angles to the transport direction (arrow 3) of the thread layer 2.

The guides 4 and 5 are longer than the width of the webs to be treated, so that in case of necessity the sewing arrangement can be moved completely to the side, whereby working within the machine stand is facilitated.

If, in the initially discussed embodiment, the thread layer 2 passes through the device along a horizontal plane, it is possible to lay out the arrangement in such a way that the thread layer 2 travels through the device in vertical direction. In that case the entire appliance as a whole or at least individual parts thereof are rotated through 90°. An additional arrangement within the framework of the invention consists in laying out the arrangement so that the web-shaped or layer-like material 19 lies between the transport plane E or the thread layer 2 and the needle head 6. In that case the narrow cloth strip 41 can be clamped directly above the shuttle head.

If in the second embodiment, the thread layer 2 passes through the installation in the working region of interest here in a vertical plane, it is entirely possible to lay out the arrangement in such a way that the thread layer 2 passes this arrangement in this region in horizontal direction. In this case the device as a whole or at least individual parts thereof are rotated through 90°. An additional arrangement within the framework of the invention lies therein that the previously described set of appliances are again arranged in mirror image fashion with respect to an imagined axis lying directly above the horizontal inlet portion of the thread layer, said axis depicted in FIG. 7 through a broken dotted broken line 69. In the second embodiment, it is shown that the retention arrangement 18 is supported in the machine stand. It is, however, also conceivable and possible, to provide the clamping jaws 21 and 22 of the retention arrangement, including the associated piston cylinder unit 68, at the horizontally displaceable slide 63, so that, as a consequence, the clamp edge of the material web 29 moves together with the slide.

The present appliance was developed in order to connect thread layers of the previously described type with layer or web-shaped materials as economically as possible. This naturally does not exclude utilization of the inventive appliance in order also to connect tissue webs with each other, the present invention being also utilizable for this without reservations.

I claim:

1. Device for producing a heat and tension resistant as well as flexible connection between a thread layer having a plurality of parallel threads and a web-shaped material, said device comprising a first retention arrangement for temporarily clamping a free end of the web-shaped material which is coiled on a storage drum and drawable therefrom, the first retention arrangement being arranged on a side of a transport plane of the thread layer; and a clamping device for temporarily clamping the thread layer, said clamping device being arranged downstream of said first retention arrangement in the transport direction of the thread layer, said clamping device having jaws which are movable toward each other, the transport plane of the thread layer extending between said jaws, characterized in that said device further comprises guides provided on both sides of the transport plane of the thread layer and transversely to the transport direction; a needle head containing at least one sewing needle for an upper thread, said needle head being arranged at one of the guides; and a shuttle head having a shuttle or gripper mechanism for a lower thread, said shuttle head being arranged at another of said guides located on the other side of the transport plane of the thread layer; wherein both said needle head and said shuttle head are driven synchronously and displaced synchronously along said guides. the first retention arrangement for temporarily clamping the free end of the web-shaped material being situated after an imagined plane, in the transport direction of the thread layer, which contains both said needle and shutter heads with the needles and shuttles.

2. Device for producing a heat and tension resistant as well as flexible connection between a thread layer having a plurality of parallel threads and a web-shaped material, said drive comprising a first retention arrangement for temporarily clamping a free end of the web-shaped material which is coiled on a storage drum and drawable therefrom, the retention arrangement being arranged on a side of a transport plane of the thread layer; and a clamping device for temporarily clamping the thread layer, said clamping device being arranged behind said retention arrangement in the transport direction of the thread layer, said clamping device having jaws which are movable towards each other, the transport plane of the thread layer extending between said jaws, characterized in that said device further comprises guides provided on at least one side of the transport plane of the thread layer transversely to its transport direction; at least one sewing device displaceably supported at said guides having a needle head including at least one sewing needle for an upper thread and a shuttle head including a shuttle or gripper mechanism for a lower thread; and that a roller pair provided between the transport plane of the thread layer and the sewing device, axes of the rollers extending parallel to the guides, wherein one roller of said roller pair lies above and the other roller lies below an imagined sewing plane standing at right angles to the working direction of the sewing needle, said rollers being spaced from each other; and a slide provided close to or in said image plane, said slide a side of the transport plane remote from the sewing arrangement, said slide being movable toward and beyond said transport plane, whereby said web-shaped material clamped by the retention arrangement and said thread layer are urged by said slide along said imagined plane to said sewing device.

3. Device according to claim 1, characterized in that the needle head (9) and the shuttle head (9) are connected with each other by a U-shaped yoke having a depth corresponding at least to a width of the thread layer which is to be treated.

4. Device according to claim 1, characterized in that the needle head viewed in transport direction of the thread layer comprises several consecutive needles and said shuttle head contains several shuttles or grippers, respectively to said several consecutive needles, the first retention arrangement is supported to be displaceable in a reciprocating manner in the transport direction of the thread layer.

5. Device according to claim 1, characterized in that the first retention arrangement is located on a same side of the transport plane of the thread layer as the needle head with the needles.

6. Device according to the claim 1, characterized in that the first retention arrangement is located on a same side of the transport plane of the thread layer as the shuttle head.

7. Device according to claim 1, characterized in that a second retention arrangement is provided on both sides of the transport plane of the thread layer, wherein the first retention arrangement comprises a pair of clamping jaws, and the second retention arrangement, for temporarily clamping a separate strip of the web-shaped material, comprises two pairs of clamping jaws which lie on opposite sides of said imagined plane.

8. Device according to claim 7, characterized in that the first and second retention arrangements are supported on a frame or a trolley which is displaceable in a reciprocating manner in the transport direction of the thread layer.

9. Device according to claim 7, characterized in that at least the second retention arrangement is supported in a frame which is raisable or lowerable with respect to the transport plane of the thread layer.

10. Device according to claim 1, characterized in that the device further comprises hold-down members coacting with the sewing needles of the needle head, said hold-down members being designed as disks supported to be freely rotatable, whose axes of rotation lie parallel to the transport direction of thread layer.

11. Device according to claim 1, characterized in that the needle head includes a plurality of sewing needles which are arranged to be offset with respect to each other in the transport direction of the thread layer of the thread layer as well as transversely thereto.

12. Device according to claim 3, characterized in that that portion of the U-shaped yoke connecting the needle and shuttle heads, which is facing away from said heads, is guided and supported.

13. Device according to claim 1, characterized in that the transport plane of the thread layer extends horizontally at least in the region of the needle and shuttle heads.

14. Device according to claim 2, characterized in that the rollers of the roller pair are displaceable with respect to each other in a imagined plane connecting their axes, for the purpose of reducing their mutual separation.

15. Device according to claim 2, characterized in that a further clamping device is arranged parallel to the guides and on the side of the sewing needle of the sewing arrangement and on that side of the sewing arrangement which faces away from the transport plane there is arranged a clamping device said further clamping device extending at least across the width of the thread layer to be treated.

16. Device according to claim 15, characterized in that the further clamping device comprises at least one clamping strip pivotable parallel to the transport plane and carrying needle-like pins spaced from each other, and the slide has slot-like recesses at its edge facing the transport plane and emanating from this edge, whose mutual spacing corresponds to the respective spacing of the pins of the clamping strip.

17. Device according to claim 2, characterized in that the slide carries the first retention arrangement, so that the end of the material is fastened at said slide itself.

18. Device according to claim 2, characterized in that the guides project beyond the transport plane or the width of the thread layer by the width of the sewing arrangement at least on one side.

19. Device according to claim 2, characterized in that a severing arrangement, extending across the width of the thread layer, is provided ahead of the roller pair in the transport direction of the thread layer.

20. Device according to claim 2, characterized in that at least one reversing roller or a reversing roll for the thread layer is provided downstream of the roller pair in the transport direction of the thread layer, this reversing roller or reversing roll (51) being supported to be displaceable against the roller pair.

21. Device according to claim 14, characterized in that the imagined plane connecting the axes of the rollers of the roller pair and the transport plane of the thread layer extend vertically in the region of the roller pair and the sewing arrangement.

22. Device according to claim 2, characterized in that the sewing arrangement comprises at least two needles having different spacings with respect to a plane connecting the axes of the rollers of the roller pair, said needles additionally being offset against each other transversely to the transport direction of the thread layer.

23. Device according to claim 2 characterized in that an additional pair of clamping strips is provided above the superimposed rollers of the roller pair, said additional pair of clamping strips holding a top edge of a cloth strip hanging freely between the transport plane and the pair of rollers.

* * * * *